US005975956A

United States Patent [19]

Huguenet

[11] Patent Number: 5,975,956

[45] Date of Patent: Nov. 2, 1999

[54] CONNECTOR SHELL

[75] Inventor: Jean-Pierre Huguenet, Biarne, France

[73] Assignee: Amphenol Socapex, France

[21] Appl. No.: 09/128,016

[22] Filed: Aug. 3, 1998

[30] Foreign Application Priority Data

Aug. 8, 1997 [FR] France ..... 97 10203

[51] Int. Cl.[6] ..... H01R 13/648

[52] U.S. Cl. ..... 439/607; 439/906

[58] Field of Search ..... 439/607–610, 439/901, 904, 906

[56] References Cited

U.S. PATENT DOCUMENTS

| | | | |
|---|---|---|---|
| 4,029,896 | 6/1977 | Skinner | 174/138 |
| 5,434,747 | 7/1995 | Shibata | 439/607 |
| 5,851,121 | 12/1998 | Thenaisie et al. | 439/608 |

FOREIGN PATENT DOCUMENTS

| | | | |
|---|---|---|---|
| 0 649 191 | 4/1995 | European Pat. Off. | H01R 13/658 |

*Primary Examiner*—Khiem Nguyen
*Attorney, Agent, or Firm*—Bacon & Thomas, PLLC

[57] ABSTRACT

The invention relates to a shell for a connector shell, the shell being constituted by two mutually snap-fastenable half-shells, the two half-shells being substantially identical and being made of a castable and electrically-conductive metal alloy. Each half-shell comprises:

a main wall including two mutually parallel side edges;

two mutually parallel ribs parallel to said edges, disposed between said edges, and projecting from said main wall;

a fixing tab extending from the first edge of said main wall parallel to said ribs and terminated by a hook facing towards said ribs; and a fixing notch formed in the second edge of said main wall and parallel to said ribs, the notch of one half-shell being suitable for co-operating with the hook of the other half-shell;

the rib closer to the first edge having a ridge defined by a sloping surface facing said fixing tab, the other rib having a ridge defined by a sloping surface facing towards the first rib.

5 Claims, 1 Drawing Sheet

CONNECTOR SHELL

FIELD OF THE INVENTION

The present invention relates to a connector shell, in particular for an electrical connector.

More precisely, the invention relates to such a shell made from two half-shells that need to be snap-fastened or clipped together to obtain said shell as a whole.

BACKGROUND OF THE INVENTION

The term electrical connector shell is used to mean a box which is fixed to the rear portion of the connector proper, said connector preferably being an electrical connector. The function of the shell is firstly to provide a mechanical link between the cable, in particular an electric cable, and the electrical connector, and secondly to surround and protect the electric cable and its electrical conductors in the region where the electrical (or possibly optical) conductors are connected to the terminals of the connector.

It is often also necessary for the shell to provide continuity of cable shielding when the cable is an electric cable in order to be prevent the electrical signals conveyed by the cable from generating disturbances in the environment and, vice versa, in order to protect the cable and its electrical connector from external electromagnetic disturbances.

In some cases, the shell of the electrical connector must be relatively complex in shape, particularly for the purpose of receiving captive screws for fixing the electrical connector to the appliance to which it is to be connected. This applies, for example, with the electrical connectors used with microcomputers.

Because of the relatively complex shape of the shell, it is advantageous to be able to make the shell out of a material that lends itself easily to molding while still having sufficient electrical conductivity to provide a satisfactory shielding effect.

Such materials include, in particular, Zamak which is an alloy based on zinc, aluminum, copper, and magnesium. The drawback of such castable metal alloys that are good conductors of electricity is that in general their capacity for reversible elastic deformation is very small. Thus, with ordinary methods, it is more or less impossible to make a shell out of two parts that can be mechanically connected together by snap-fastening means. However, the snap-fastening technique is well known for shells or connector elements made out of moldable plastics materials.

OBJECTS AND SUMMARY OF THE INVENTION

An object of the present invention is to provide a shell for a connector, in particular an electrical connector, in which the shell is made up of two half-shells that are capable of being assembled together by snap-fastening.

To achieve this object, according to the invention, in the shell for a connector constituted by two mutually snap-fastenable half-shells, the two half-shells are substantially identical and made of a castable electrically-conductive metal alloy, and each half-shell comprises:

- a main wall including two mutually parallel side edges;
- two mutually parallel ribs parallel to said edges, disposed between said edges, and projecting from said main wall;
- a fixing tab extending from the first edge of said main wall parallel to said ribs and terminated by a hook facing towards said ribs; and

- a fixing notch formed in the second edge of said main wall and parallel to said ribs, the notch of one half-shell being suitable for co-operating with the hook of the other half-shell;

the rib closer to the first edge having a ridge defined by a sloping surface facing said fixing tab, the other rib having a ridge defined by a sloping surface facing towards the first rib.

It will be understood that because of the special shape given to the edges of the two ribs of each half-shell, and because the fixing hook is disposed at the end of an arm that is of a certain length, it is possible, in spite of the nature of the material, to obtain a small amount of simultaneous elastic deformation of said arms and of the two edges of the ribs that come into contact with one another in such a manner as to obtain effective snap-fastening of the two half-shells by co-operation between the hook and the corresponding fixing notch, while implementing non-permanent elastic deformation only, thereby making it possible to assemble and disassemble the shell.

In a preferred embodiment, in the shell said hook has a chamfer on its face remote from said main wall and said hook is defined by a projecting portion of the main wall that has a chamfer suitable for co-operating with the chamfer of said hook when the two half-shells face each other.

It will be understood that because of the presence of two chamfers which co-operate with each other during the snap-fastening operation, a certain amount of elastic deformation of the tab having the snap-fastening hook fixed to the end thereof is made easier.

BRIEF DESCRIPTION OF THE DRAWING

Other characteristics and advantages of the invention appear better on reading the following description of a preferred embodiment of the invention given by way of non-limiting example. The description refers to the accompanying figures, in which.

MORE DETAILED DESCRIPTION

According to a characteristic of the invention, the two half-shells constituting the shell are identical, at least so far as their fixing means are concerned. Only one of the two half-shells, referenced A, is therefore described in detail.

Figure 1:
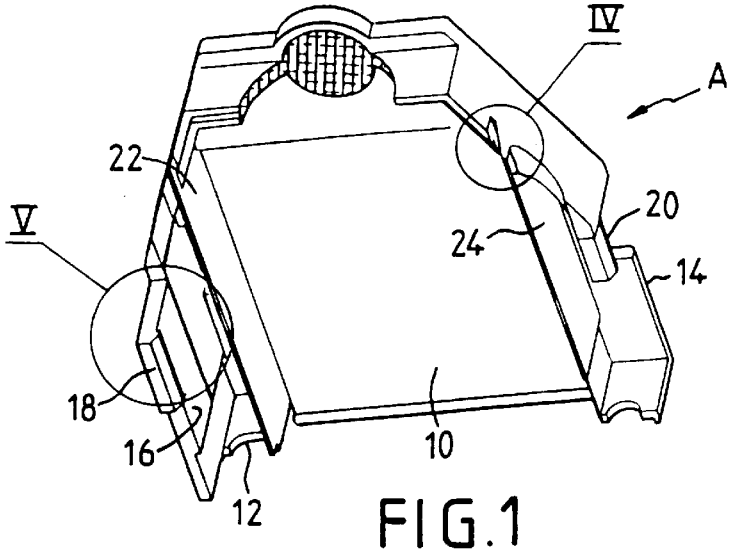
FIG. 1 is a perspective view of a half-shell of the shell.
Figure 2:
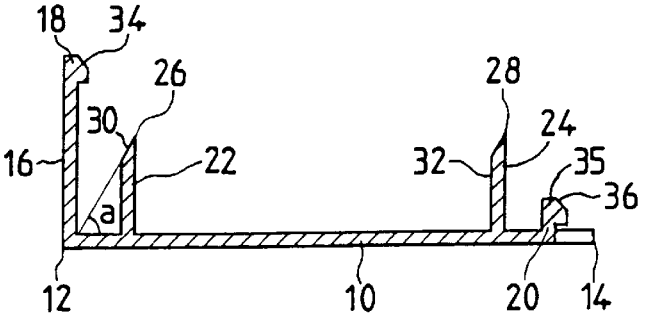
FIG. 2 is a cross-section view of a half-shell.
Figure 4:
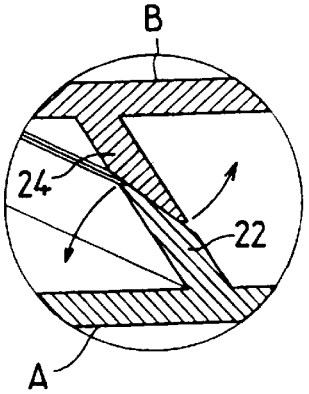
FIG. 4 is a detail perspective view showing co-operation between the ridges of the ribs.

With reference initially to FIGS. 1 and 2, a preferred embodiment of a half-shell for an electrical connector shell is described.

As already explained, the two half-shells are made of a castable electrically-conductive metal alloy. The metal alloy is typically a Zamak alloy, of composition as given above. Each half-shell has a main wall 10 with two longitudinally-extending side edges 12 and 14. The edge 12 is fitted with a fixing tab 16 extending substantially perpendicularly to the main wall 10 of the half-shell. This fixing tab represents only a portion of the length of the half-shell and it is terminated by a hook 18 projecting away from the tab 16 towards the inside of the half-shell. Symmetrically, the second longitudinally-extending side edge of the main wall 10 is provided with a fixing notches 20 running along the edge 14 for co-operating with the hook 18 of the other half-shell B. The half-shell A also has two internal ribs 22 and 24 which are parallel to each other and to the fixing tab 16. These ribs 22 and 24 are naturally located between the edges 12 and 14 of the main wall 10. As a result, the ribs 22 and 24 are substantially perpendicular to the plane of the main wall 10 of the half-shell. The gaps between the ribs and the edges of the main walls of the half-shells are used for receiving captive screws that serve for fixing the connector to an appliance associated with the connector.

With reference more particularly to FIG. 2, it can be seen that the ribs 22 and 24 have respective edges in the form of ridges given references 26 and 28. These ridge-shaped edges are obtained by the presence of respective sloping surfaces 30 and 32 defining them. For the rib 22, the sloping surface 30 faces the fixing tab 16, whereas for the rib 24, the sloping surface 32 faces towards the inside of the half-shell.

FIG. 2 also shows that the top portion of the hook 18, i.e. the portion furthest away from the main wall, is provided with a chamfer 34 and it can also be seen that the fixing notch 20 is surmounted by a solid projecting portion 35 whose top end is likewise provided with a chamfer 36.

It should be specified that the dihedral angle between the surfaces 20 and 32 and the plane of the main wall 10, referenced a in FIG. 2, lies in the range 50° to 70°.

Figure 3:
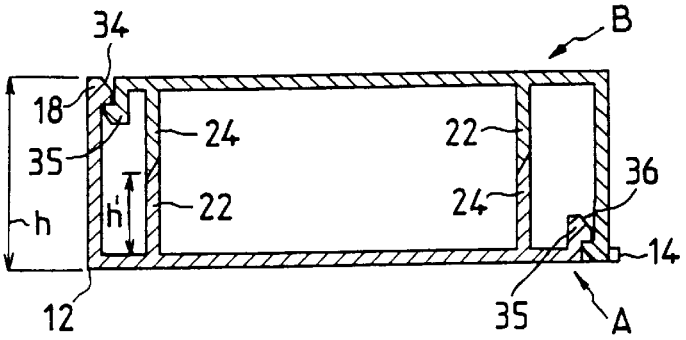
FIG. 3 is a cross-section view of two assembled-together half-shells.
Figure 5:
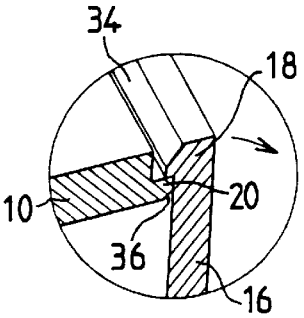
FIG. 5 is a detail view showing co-operation between the hook and the notch for fixing the two half-shells together.

FIG. 3 shows two half-shells A and B snap-fastened together. During the snap-fastening operation, the sloping surfaces of the ribs 22 and 24 respectively of half-shells A and B enter progressively into contact simultaneously with the chamfer 34 of the hook 18 of half-shell A coming into contact with the chamfer 36 of the solid part 35 of half-shell B. These sloping contacts tend to cause limited and temporary separation of the rib 22 of half-shell A relative to the fixing tab 16 of the same half-shell A. Naturally, the same disposition occurs for the rib 22 of half-shell B and the rib 24 of half-shell A, and for chamfer 36 of half-shell A and chamfer 34 of the hook 18 of half-shell B.

By means of this disposition, the temporary separation obtained is sufficient to allow the hooks 18 to snap into the notches 20 respectively of half-shell A into half-shell B and of half-shell B into half-shell A. This provides a snap-fastening link between the two half-shells A and B. Since the deformation involved is not permanent, it is possible to assemble and disassemble the shell on successive occasions.

It should also be specified that the length h of the fixing tab 16 is equal to the thickness of the shell. Similarly, the running portions of the ribs 22 and 24 are of a height h' that is substantially equal to half the thickness of the shell.

I claim:

1. A connector shell constituted by two mutually snap-fastenable half-shells, wherein the two half-shells are substantially identical and made of a castable electrically-conductive metal alloy, and wherein each half-shell comprises:

a main wall including two mutually parallel first and second side edges;

two mutually parallel ribs parallel to said edges, disposed between said edges, and projecting from said main wall;

a fixing tab extending from the first edge of said main wall parallel to said ribs and terminated by a hook facing towards said ribs; and a fixing notch formed in the second edge of said main wall and parallel to said ribs, the notch of one half-shell being suitable for co-operating with the hook of the other half-shell;

the rib closer to the first edge having a ridge defined by a sloping surface facing said fixing tab, the other rib having a ridge defined by a sloping surface facing towards the first rib.

2. A shell according to claim 1, wherein said hook has a chamfer on its face remote from said main wall and wherein said hook is defined by a projecting portion of the main wall that has a chamfer suitable for co-operating with the chamfer of said hook when the two half-shells face each other.

3. A shell according to claim 1, wherein the sloping surfaces defining the edges of the two ribs are parallel.

4. A shell according to claim 1, wherein the dihedral angle a between the loping surfaces and the main wall of the half-shell lies in the range 50° to 70°.

5. A shell according to claim 1, wherein the two half-shells are made of Zamak.

* * * * *

UNITED STATES PATENT AND TRADEMARK OFFICE

CERTIFICATE OF CORRECTION

PATENT NO. : 5,975,956

DATED : November 2, 1999

INVENTOR(S) : Jean-Pierre HUGUENET

It is certified that an error appears in the above-identified patent and that said Letters Patent is hereby corrected as shown below:

Column 4, line 39 (Claim 4), "loping" should read –sloping–.

Signed and Sealed this

First Day of May, 2001

*Attest:*

Nicholas P. Godici

NICHOLAS P. GODICI

*Attesting Officer*

*Acting Director of the United States Patent and Trademark Office*